US008585429B2

(12) United States Patent
Rouillard et al.

(10) Patent No.: US 8,585,429 B2
(45) Date of Patent: Nov. 19, 2013

(54) ELECTRICAL CONNECTOR COMPRISING A GUIDING PROTRUSION OR POCKET WITH A FLEXIBLE FASTENING MEMBER

(75) Inventors: Xavier Rouillard, Franconville (FR); Francois Jodon de Villeroche, La Celle Saint Cloud (FR); Dimitri Bance, Cergy (FR)

(73) Assignee: Tyco Electronics France SAS, Pontoise (FR)

( * ) Notice: Subject to any disclaimer, the term of this patent is extended or adjusted under 35 U.S.C. 154(b) by 242 days.

(21) Appl. No.: 12/931,942

(22) Filed: Feb. 15, 2011

(65) Prior Publication Data

US 2011/0201225 A1 Aug. 18, 2011

(30) Foreign Application Priority Data

Feb. 15, 2010 (FR) ..... 10 00626

(51) Int. Cl.
*H01R 13/62* (2006.01)

(52) U.S. Cl.
USPC ..... 439/378; 439/953

(58) Field of Classification Search
USPC ..... 439/374, 378, 593, 677, 682, 848, 953
See application file for complete search history.

(56) References Cited

U.S. PATENT DOCUMENTS 3,706,067 A * 12/1972 Hanson ..... 439/155
4,083,619 A * 4/1978 McCormick et al. ..... 439/310
5,074,807 A * 12/1991 Parmer ..... 439/553
5,586,893 A * 12/1996 Mosquera ..... 439/108
5,689,598 A * 11/1997 Dean et al. ..... 385/59
5,848,456 A * 12/1998 Sjoqvist ..... 24/618
6,146,210 A * 11/2000 Cha et al. ..... 439/680
6,165,009 A * 12/2000 Anbo et al. ..... 439/498
6,843,677 B2 * 1/2005 Fukuda ..... 439/374
6,846,191 B2 * 1/2005 Hobbs et al. ..... 439/157
6,902,438 B2 * 6/2005 Tsuyama ..... 439/694
6,984,143 B2 * 1/2006 Roese ..... 439/352
8,007,305 B2 * 8/2011 Chen ..... 439/357
8,052,441 B2 * 11/2011 Senatori et al. ..... 439/171
8,192,221 B2 * 6/2012 Schmettkamp et al. ..... 439/345
8,313,336 B2 * 11/2012 Bondo et al. ..... 439/324
2004/0147158 A1 * 7/2004 Hobbs et al. ..... 439/378
2005/0186855 A1 * 8/2005 Shimizu et al. ..... 439/682

* cited by examiner

*Primary Examiner* — Neil Abrams
*Assistant Examiner* — Travis Chambers
(74) *Attorney, Agent, or Firm* — Faegre Baker Daniels LLP

(57) ABSTRACT

The present invention relates to an electrical connector, a coupling electrical connector and an electrical connector assembly, the electrical connector including a guiding protuberance protruding from its socket face parallel to a coupling direction, the coupling electrical connector being designed with a guiding pocket for receiving the guiding protuberance. In order to improve the strength of a connection between the two electrical connectors, even when the electrical connector assembly experiences vibrations, the invention provides that at least one of the electrical connectors includes a fixing element which is elastically deformable on at least one section along a direction perpendicular to the coupling direction according to the invention.

24 Claims, 9 Drawing Sheets

ELECTRICAL CONNECTOR COMPRISING A GUIDING PROTRUSION OR POCKET WITH A FLEXIBLE FASTENING MEMBER

The present invention relates to an electrical connector for an electrical connector assembly, the electrical connector being designed to be connected to a coupling electrical connector along a coupling direction, the electrical connector including a socket face with at least one contact section and with a guiding protuberance protruding from the socket face, parallel to the coupling direction.

The present invention also relates to an electrical connector for an electrical connector assembly, the electrical connector being designed to be connected to a coupling electrical connector along a coupling direction, the electrical connector including a socket face with a guiding pocket for receiving a guiding protuberance of the coupling electrical connector along the coupling direction, the guiding pocket opening towards the socket face and extending parallel to the coupling direction.

Moreover, the present invention relates to an electrical connector assembly with at least two electrical connectors designed to be connected together along a coupling direction.

Electrical connectors are already known which include guiding elements which may have the form of guiding protuberances or guiding pockets. In particular, guiding protuberances which extend the contact section of the socket face along the coupling direction interact with guiding pockets or coupling electrical connectors before the contacts of the aforementioned at least two electrical connectors make contact with each other. The guiding protuberances and the guiding pockets guide the movements of the electrical connectors during a connection procedure and prevent distortion of the electrical connectors or damage to the contacts, which increases the tolerance to incorrect handling of the connection procedure. In particular, guiding surfaces parallel to the coupling direction of guiding protuberances and cylindrical guiding pockets with a polygonal impression firmly guide the electrical connectors. In known connectors, the guiding protuberances and guiding pockets are designed in a complementary manner.

Substantially flat guiding protuberances, which have the shape of a blade or a plate combined with guiding pockets in the shape of a casing or sheath, are extremely effective in guiding the movements of the electrical connectors as at a least two guiding surfaces of the guiding protuberance and the guiding pockets are much wider than the remaining guiding surfaces.

However, the electrical connector assemblies of said at least two coupled connectors may be damaged if the assembly is used in environments which create forces which tend to open the electrical connector assembly. This type of environment may be a motor vehicle or any other mobile machine. The retention forces between the electrical contacts of the coupled connectors may not be sufficient to guarantee the connection, especially when the assembly experiences vibrations. The operation of the machine may be compromised if the connection is interrupted.

Due to these known disadvantages of electrical connectors, a purpose of the present invention is to provide electrical connectors and electrical connector assemblies which better guarantee their connections compared with known electrical connectors, even when the electrical connector assembly experiences mechanical vibrations.

This purpose is achieved, according to the invention, for the aforementioned electrical connector in that the guiding protuberance is provided with a fixing element which is elastically deformable over at least a portion thereof along a direction perpendicular to the coupling direction.

With regard to the aforementioned electrical connector with the guiding pocket, the purpose is fulfilled, according to the invention, in that a fixing element is arranged in the guiding pocket, said element being elastically deformable over at least a portion thereof, perpendicular to the coupling direction.

With regard to the aforementioned electrical connector assembly, the purpose is fulfilled, according to the present invention, in that at least one of the electrical connectors is designed according to the invention, the fixing element being arranged in the guiding pocket and being elastically deformed over at least a portion thereof, perpendicular to the coupling direction, providing a force fit of the guiding protuberance with the guiding pocket, which occurs at least when the electrical connectors are fully connected.

These simple solutions provide an additional retention force created by the connectors of the connector assembly and in particular by the force fit generated by the fixing element. The forces, and in particular vibration forces, acting on at least one connector of the connector assembly are counterbalanced by the force fit, so that the forces or external vibrations cannot break the connection between the two connectors. Consequently, the electrical connector assembly according to the invention is more suitable for use in arduous environments, such as motor vehicles.

The solution according to the invention may be combined where necessary and improved using the following additional embodiments, which are advantageous in themselves in each stipulated case.

According to a first possible embodiment, the fixing element may be arranged on a guiding surface disposed parallel to the coupling direction. The guiding protuberance and the guiding pocket may both be designed with at least one guiding surface parallel to the coupling direction. In particular, when the guiding protuberance is in the shape of a plate or a blade, the large flat surfaces of the guiding protuberance may constitute guiding surfaces. The guiding pocket corresponding to this type of guiding protuberance has the shape of a casing, sheath or box, with a least two large side walls which extend parallel to the coupling direction and form the guiding surfaces.

If the electrical connector is also provided with a fixing element, the fixing elements may be arranged on the same guiding surfaces or on other guiding surfaces. In particular, the fixing elements may be arranged on the guiding faces that are opposite to the guiding protuberance and may be directed in contrary directions, or they may be arranged on the guiding surfaces opposite to the guiding pockets and be opposite each other. As a variant, the fixing elements may be arranged at a given distance from each other, perpendicular to the coupling direction.

In a further advantageous embodiment of the electrical connector, the fixing element may protrude perpendicular to the coupling direction. An electrical connector with this type of fixing element which protrudes from the guiding surface perpendicular to the coupling direction may be used with a coupling connector of conventional shape relative to known connectors.

If the fixing element is, for example, arranged on the guiding projection by protruding from the guiding surface, the guiding pocket of the coupling connector must not be provided with a fixing element according to the invention. As the conventional guiding pocket is basically complementary relative to the elements of the guiding protuberance which are not designed according to the invention, the protruding fixing element will be forced from its non-distorted or rest position towards the guiding protuberance and into a distorted position when the guiding projection is inserted into the guiding pocket. Due to its elastic deformation, the fixing element exerts a retention force on the side wall or guiding surface opposite to the guiding pocket. This retention force produces a force fit between the two connectors, and in particular between the guiding protuberance and the guiding pocket. The force fit securely retains the electrical connectors and firmly fixes them together.

If the fixing element is arranged on the side wall or the guiding surface of the guiding pocket it is forced towards this side wall and is separated from the guiding pocket by the guiding protuberance, which may be of conventional shape. In this case, the fixing element exerts pressure against the guiding surface opposite to the guiding protuberance.

The fixing element which protrudes from the guiding surface may be in the shape of a bridge, a tongue or a spring leaf, which are basically arc-shaped. This type of fixing element may have a semi-convex shape, at least over a portion thereof. Fixing elements without edges perpendicular to the coupling direction distribute these deformation forces in a particularly efficient manner.

A fixing element in the shape of a bridge or a spring leaf may include two ends oriented in the opposite direction to the direction of the plug and which may be attached to the guiding surface. With this type of fixing element, high retention forces and durable force fitting may be obtained. The mechanical load exerted on this type of fixing element may, however, produce more rapid deterioration of its structure compared with a fixing element in the shape of a tongue. A free end of a fixing element in the shape of a tongue may perform non-controlled movements when the fixing element is deformed, thus preventing compression of the fixing element, which may cause damage thereto overtime. In particular, when the free end of the fixing element is directed opposite the longitudinal direction of the connector, said longitudinal direction being the direction along which the socket face is directed, catching the guiding protuberance during the connection procedure may be avoided. Furthermore, a fixing element in the shape of a tongue, the free end of which is directed opposite the longitudinal direction, acts as a catch or an anchor, by providing an additional fixation for the connection of the two connectors in order to prevent them from separating.

In a further advantageous embodiment of the electrical connector, the fixing element may include a resilient section which is more flexible than the surrounding sections of the electrical connector. The combination of a rigid environment, which is not significantly deformed during the coupling procedure, with a flexible resilient section prevents the resilient section from being displaced or deformed in error during the coupling procedure. The resilient section may extend over the whole of the fixing element or the fixing element may be constituted by the resilient section.

Furthermore, in order for the fixing element to protrude relative to the guiding surface, the fixing element may be provided with a displacement component. The displacement component may protrude perpendicular to the coupling direction in order to generate or increase the protuberance of the fixing element relative to the guiding surface. The displacement component may be a protuberance in the shape of a bead or a rib protruding perpendicular relative to the coupling direction. A protuberance in the shape of a bead generates a retention force or high and localised concentrated pressure which provides a force fit. However, during connection or opening of the electrical connector assembly, pressure peaks may produce damage, such as grooves in the opposing guiding surface of the protuberance in the shape of a bead. In order to better distribute the retention force over the opposing guiding surface a protuberance in the shape of a rib is preferred.

In a further advantageous embodiment, the displacement component may be integral with the fixing element. This type of displacement component may not be easily separated from the fixing element and is easy to produce, for example, by a joint injection moulding of the fixing element and the displacement component. The fixing element may also be integral with the socket face, which face may be integral with a support body for the electrical contact elements of the electrical connector. The support body including the fixing element, the socket face and the guiding protuberance or the guiding pocket may be, for example, easily produced by injection moulding in a single production step. The support body therefore may be quick and cheap to produce.

In order to fully benefit from the shape and arrangement of the displacement component and the fixing element, the displacement component may be created separately from the fixing element and arranged on the guiding surface opposite to the fixing element when the electrical connectors are connected to form the electrical connector assembly. The fixing elements may consequently include a protruding resilient section or a resilient section provided with a displacement component or a resilient section which interacts with a displacement component arranged on a guiding surface opposite the resilient section at least when the connectors are fully connected.

A deformation receptacle may be arranged on the edge of the fixing element, perpendicular to the coupling direction, providing a space to receive the fixing element which is at least deformed on one section. If the deformation receptacle is not present, the resilient section may not have greater flexibility than the surrounding sections of the electrical connector. The deformation receptacle may be designed so that the fixing element does not make contact with the material of the support body at the opposite end or at the base of the deformation receptacle due to its deformation. The fixing element may be therefore easily forced over at least a portion thereof into the deformation receptacle.

However, the fixing element may be overstressed by incorrect handling and if it is, for example, entirely forced into the deformation receptacle. The deformation receptacle may be consequently designed so as to act as a dead stop for the fixing element. In this case, the fixing element makes abutment with the base of the deformation receptacle arranged opposite the fixing element, preventing it from being overstressed. As a variant, the deformation receptacle may be filled with a flexible material which generates a force opposing the deformation of the fixing element and which increases proportionately with its deformation.

The invention will be described in further detail hereafter and, by way of example, using the advantageous embodiments and with regard to the drawings. The embodiments described are possible configurations only, wherein the individual features, as previously described, nevertheless may be applied independently from each other or omitted from the drawings.

Figure 1:
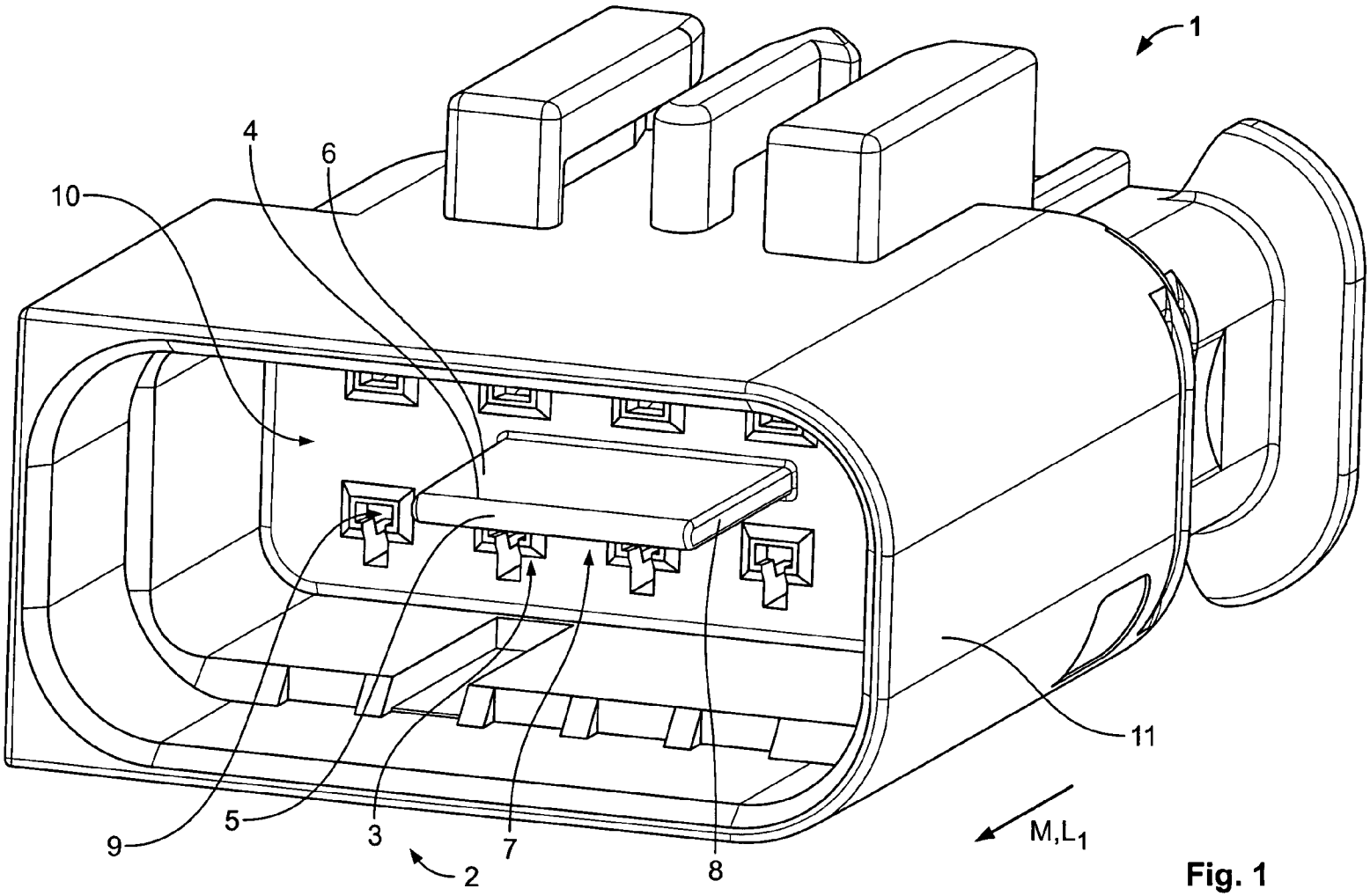
FIG. 1, is a perspective schematic view of an embodiment of an electrical connector.

An electrical connector 1 with a socket face 2 will be initially described with reference to FIG. 1. The socket face 2, in which a contact section 3 with several contact elements is arranged so as to be accessible by another electrical connector or coupling connector, is directed along a longitudinal direction $L_1$ of the electrical connector 1. The longitudinal direction $L_1$ follows a coupling direction M, along which the electrical connector 1 may be connected or coupled with the other electrical connector or coupling electrical connector.

In the socket face 2, a substantially flat guiding protuberance 4 is provided and is basically arranged at the centre of the socket face 2. The guiding protuberance 4 has the shape of a plate or blade and protrudes from the socket face 2 along the coupling direction M. Its front section 5 extends perpendicular to the coupling direction M. The edges of the front section 5 are flat or round so as to prevent the guiding protuberance 4 from distorting during a procedure for connecting the electrical connector 1 and the coupling connector. The guiding protuberance 4 includes two guiding surfaces 6, 7 which extend parallel to the longitudinal direction $L_1$ of the electrical connector 1. The guiding surfaces 6, 7 are the most important surfaces of the guiding protuberance 4. Furthermore, the guiding protuberance 4 is designed with the edges or the surfaces 8, 9 arranged at right angles relative to the guiding surfaces 6, 7. The edges 8, 9 thus contribute to the guiding function of the guiding protuberance 4 and may therefore also be designated as guiding surfaces 8, 9.

The socket face 2 forms part of a support body 10, which is arranged in a connector housing 11 of the electrical connector 1. The support body 10 includes openings for receiving the contacts, wherein the contact elements are firmly inserted. The guiding protuberance 4 may be fixed to the support body 10. The embodiment in FIG. 1 is designed integral with the support body 10.

The electrical connector 1 may be connected to the electrical coupling connector, which may be a conventional product or even be designed according to the invention. As a variant, the electrical connector 1 may be a standard connector without the improvements according to the invention if the electrical coupling connector is designed according to the invention.

Figure 2:
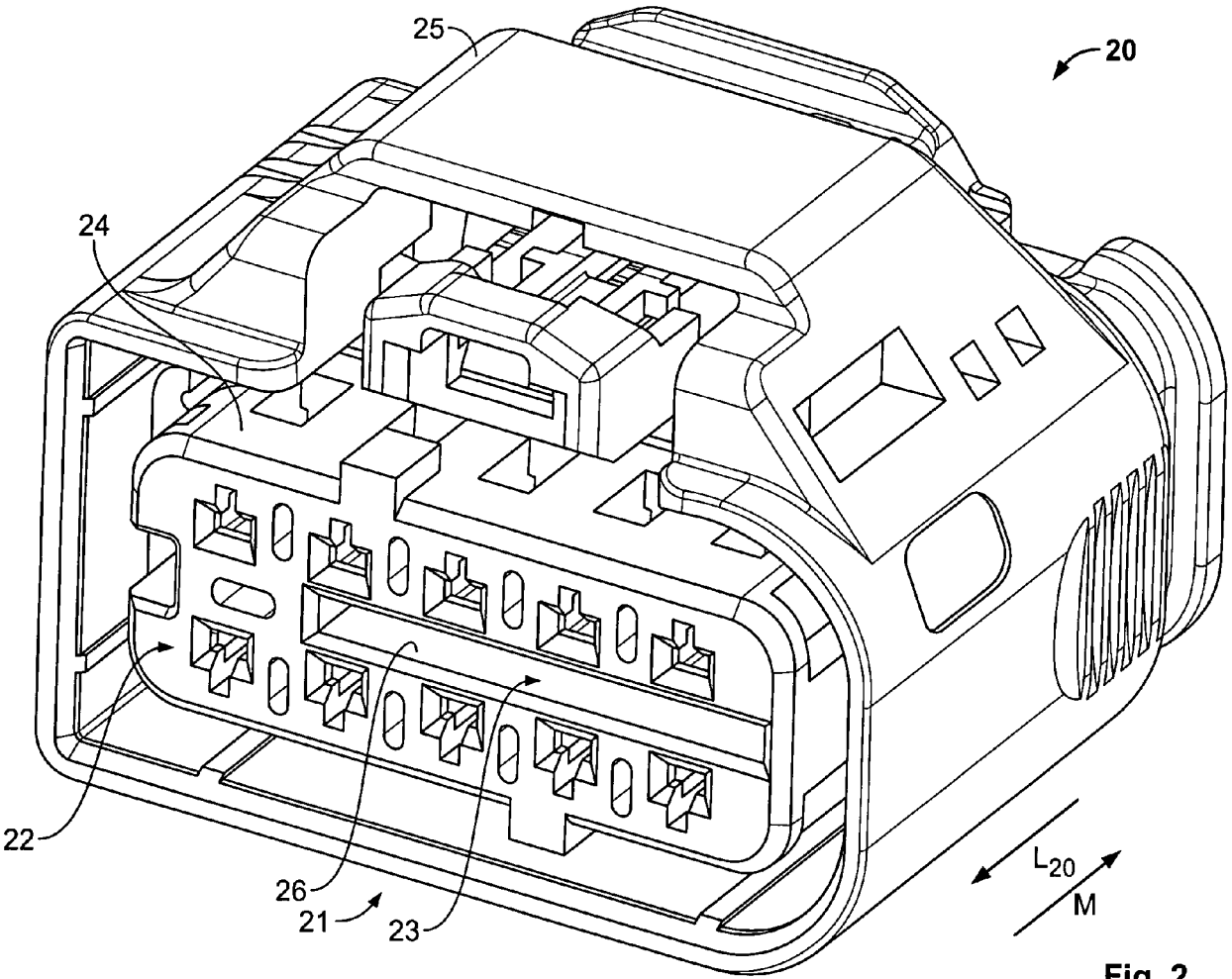
FIG. 2, is a perspective schematic view of an embodiment of another electrical connector.

FIG. 2 shows a first embodiment of the other electrical connector or electrical coupling connector 20, which includes a socket face 21 directed along a longitudinal direction $L_{20}$ of the electrical coupling connector 20. The longitudinal direction $L_{20}$ is opposite the coupling direction M.

The socket face 21 is also designed with a contact section 22 including different contact elements for contacting the contact elements of the electrical connector 1. The contact elements may also be designated as coupling contacts. Furthermore, a guiding pocket 23 is arranged in the socket face 21. The guiding pocket 23 opens towards the socket face 21 along the longitudinal direction $L_{20}$ and extends along the coupling direction M in a support body 24 of the electrical coupling connector 20. The support body 24 is arranged in a coupling connector housing 25.

A fixing element according to the invention may be arranged in the guiding pocket 23, which provides an electrical coupling connector 20 with the advantages of the invention. In particular, the fixing element may be arranged on a guiding surface 26 of the guiding pocket 23. The guiding surface 26 and other guiding surfaces of the guiding pocket 23 extend along the coupling direction M. In the embodiment shown, the guiding pocket 23 includes four guiding surfaces which all extend parallel to the coupling direction M and form side walls of the guiding pocket 23. As a variant, and as shown in FIG. 2, the electrical coupling connector 20 may be a standard product if the fixing element is arranged in the electrical connector 1.

In the embodiment shown, the electrical coupling connector 20 is a socket for the electrical connector 1. As a variant, the electrical connector 1 with the guiding protuberance 4 may be designed as a socket for the electrical coupling connector 20.

Figure 3:
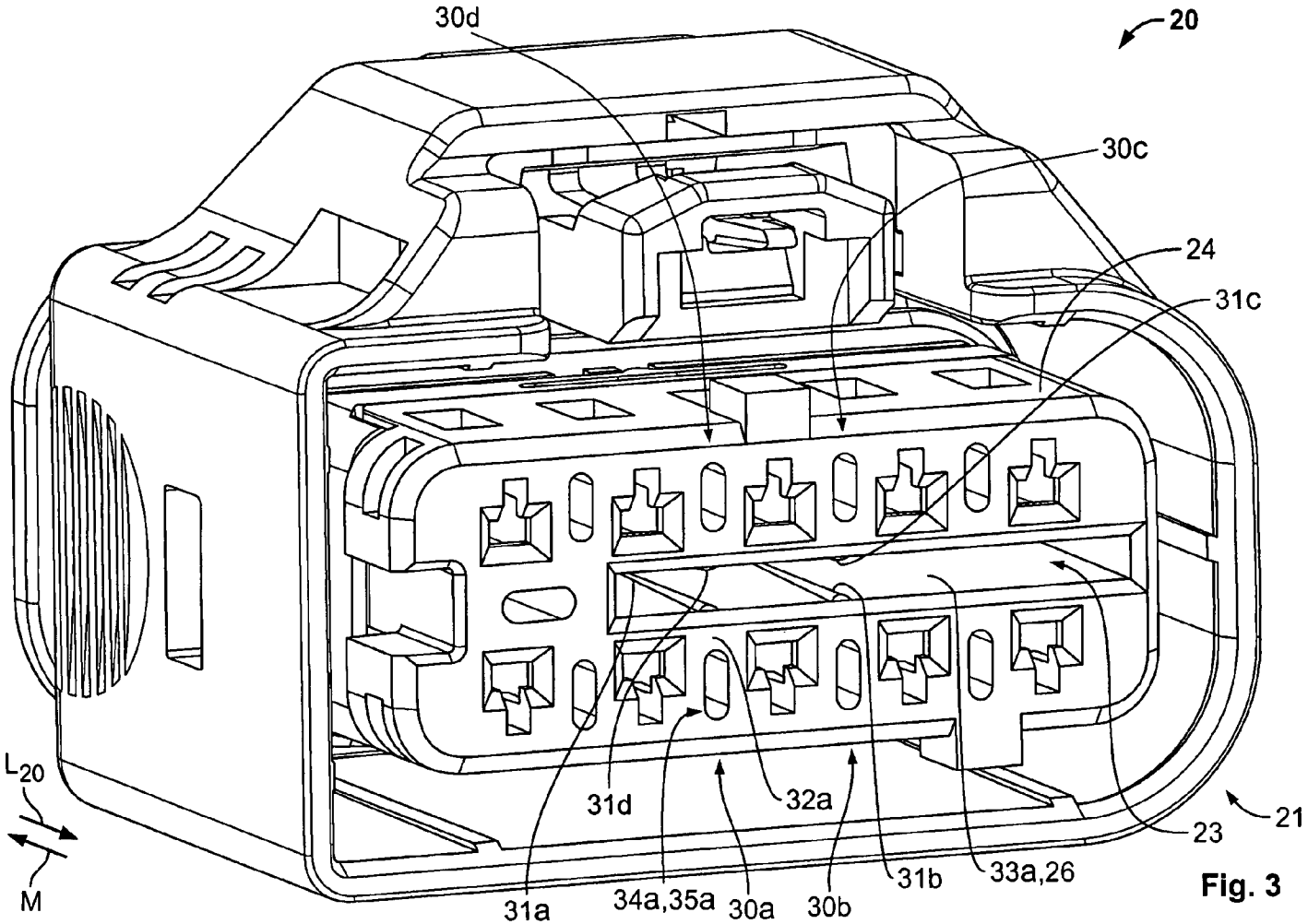
FIG. 3, is an electrical connector according to FIG. 2, with a first embodiment of a fixing element in a perspective schematic view.

FIG. 3 shows a further embodiment of the electrical coupling connector 20 in a schematic perspective view. The same references are used for the elements which correspond by their function or their structure to the elements of the embodiment in FIG. 2. For the sake of conciseness, only the differences relative to the embodiment of FIG. 2 will be described.

The electrical coupling connector 20 is shown in an exploded view, the socket face or the coupling socket face 21 being outside the plane of projection.

The socket face 21, which is integral with the support body 24, is provided with four fixing elements 30*a-d*. The fixing elements 30*a-d* are described in detail in the following embodiment of the fixing element 30*a*.

The fixing element 30*a* includes a displacement component 31*a* and a resilient section 32*a*. The displacement component 31*a* is arranged on a side wall 33 of the guiding pocket 23, the side wall 33*a* being one of the largest guiding surfaces and in particular the guiding surface 26 of the guiding pocket 23 in the shape of a box. The displacement component 31*a* protrudes perpendicular to the coupling direction M and in the guiding pocket 23. It extends parallel to the coupling direction M, beginning at the socket face 21 of the coupling and continuing along the coupling direction M in the guiding pocket 23. As a variant, the displacement component 31*a* may begin at a certain distance from the socket face 21 and not extend to the end or to the base of the guiding pocket 23. In particular, the displacement component 31*a* may not be designed in accordance with the rib shown, but as at least one protuberance in the shape of a bead arranged along the coupling direction M.

Furthermore, at least one of the fixing elements 30*a-d* may be arranged on the smallest side walls or guiding surfaces of the guiding pocket 23 in the shape of a box.

The resilient section 32*a* forms part of the side wall 33 and makes abutment with the deflecting element 31*a* perpendicular to the longitudinal direction $L_{20}$. The resilient section 32*a* is arranged between the displacement component 31*a* and a deformation receptacle 34*a*. The deformation receptacle 34*a* provides the elastic features of the resilient section 32*a*. On the one hand, the material of the support body 24 between the displacement component 31*a* and the deformation receptacle 34*a* is thinned so that the resilient section 32*a* is elastically deformable. On the other hand, the deformation receptacle 34*a* has a space 35 wherein the resilient section 32*a* may be forced at least over a portion thereof. The sections of the support body 24 in the zone of the deformation receptacle 34*a* may be elastically deformed by forcing the resilient section 32*a* towards the free space 35. The resilient section 32*a* is, however, generally more flexible than the surrounding sections of the support body 24.

In this embodiment, the electrical coupling connector 20 is provided with two pairs of fixing elements 30*a-d*, the fixing elements 30*a, d* and 30*b, c* being arranged opposite each other, perpendicular to the coupling direction M. The fixing elements 30*a, d*, as well as 30*b, c* oppose each other respectively. Of course, the electrical coupling connector 20 may be designed with more or less fixing elements 30*a-d*, which may be arranged in different ways.

As a variant, the fixing elements 30*a-d*, and in particular the displacement components 31*a-d*, may be arranged on the guiding protuberance 4 of the electrical connector 1. In this case, and if at least two displacement components 31*a-d* are arranged on the guiding protuberance 4, the displacement components 31*a-d* may be arranged back-to-back.

Figure 5:
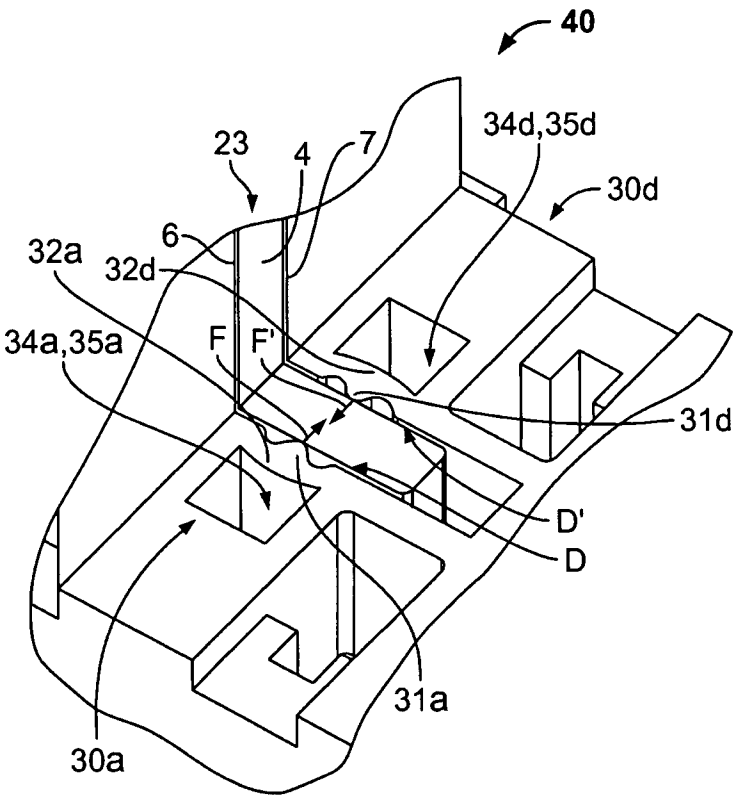
FIG. 5, is an embodiment according to FIG. 4, with a guiding protuberance of the other electrical connector according to FIG. 1 inserted into a guiding pocket.
Figure 4:
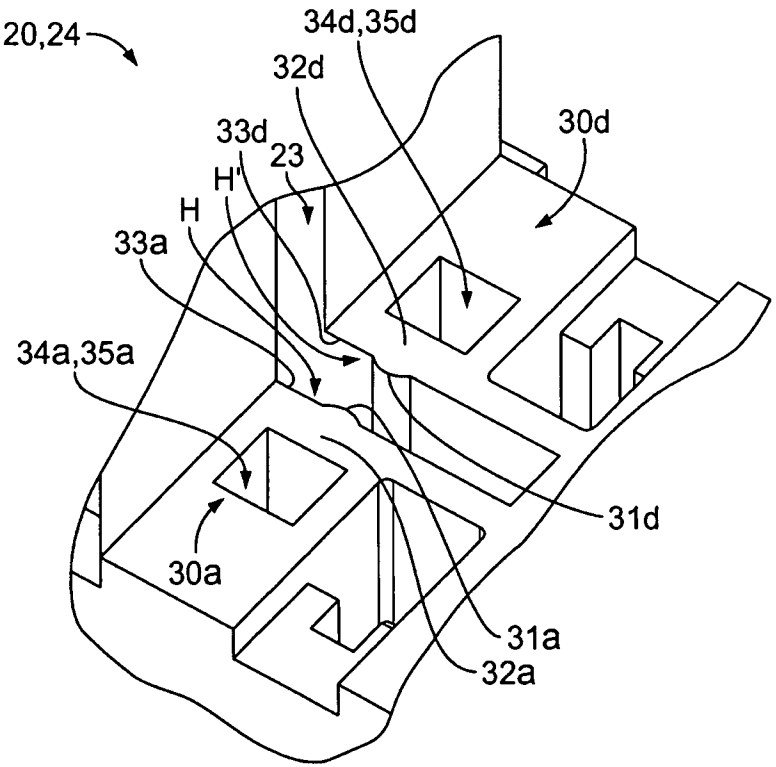
FIG. 4, is an electrical connector according to FIG. 3, in a cut-out schematic perspective view.

FIGS. 4 and 5 show an embodiment according to FIG. 3, as a cut-out perspective schematic view basically perpendicular to the coupling direction M. The electrical coupling connector 20 is shown in 4 without the guiding protuberance 4 inserted into the guiding pocket 23, and in FIG. 5 with this type of protuberance.

A cutting plane is arranged transversally to the coupling direction M, at the height of the displacement components 31*a, d*. The fixing elements 30*a, d* are arranged on the side walls 33*a, d* opposite to the guiding pocket 23 and are opposite each other. The displacement components 31*a, d* both protrude from the guiding pocket 23 and are arranged on the resilient sections 32*a, d*, which are integral with the support body 24. The sections of the side walls 33 *a, d* forming the resilient sections 32*a, d* are in the shape of a spring leaf, the spring leaf including two fixed ends. When viewed from the guiding pocket 23, the deformation receptacles 34*a, d* with their free spaces 35*a, d* are arranged behind the displacement components 31*a, d* and the resilient sections 32*a, d*. In this case, the deformation receptacles 34 *a*, are of cylindrical shape, with a square impression. The deformation receptacles 34*a, d*, as well as other deformation receptacles, arranged near the displacement components, of other fixing elements may, of course, have another impression, for example, triangular, rectangular or other. In FIG. 4, the fixing elements 30*a, d*, are shown in a non-distorted or rest H, H' position.

In FIG. 5, the guiding protuberance 4 of the electrical coupling connector 1 is inserted at least over a portion thereof into the guiding pocket 23. The electrical connector 1 and the electrical coupling connector 20 form the electrical connector assembly 40 shown, at least when it is fully connected. Apart from the displacement components 31*a*, d, the cross-section of the guiding pocket 23 is substantially complementary to the cross-section of the guiding protuberance 24. If the guiding protuberance 4 is thus inserted into the guiding pocket 23, the guiding protuberance 4 tends to make the displacement components 31*a, d* exit from the guiding pocket 23. Due to the elastic properties of the resilient sections 32*a, d* the resilient section 32 *a, d* may be deformed at least over a portion thereof and is forced from its rest position in H, H', shown in FIG. 4, in a distorted position D, D' of FIG. 5. As the displacement components 31*a, d* are fixed to the resilient sections 32*a, d*, they follow the movement of the resilient sections 32*a, d* from their rest position H, H' up to their distorted position D, D'. If the displacement components 31*a, d* are arranged on the guiding surfaces 6, 7 of the guiding protuberance 4, their position will not change during the forced movements of the resilient sections 32*a, d*.

The resilient sections 32*a, d* which are deflected generate restoring forces F, F' directed perpendicular to the coupling direction M and towards the guiding pocket 23, at least bearing on the displacement components 30*a-d* against the guiding protuberance 4. The resulting force fit contributes to maintaining the connection between the electrical connector 1 and the coupling electrical connector 20, even if vibrations or other forces tend to open the fitted connection.

In particular, if the displacement components 31*a, d* and the resilient sections 32*a, d* are either integral with the electrical connector 1, or integral with the coupling electrical connector 20, the counter-connector (electrical connector 20 or electrical connector 1) may be of the conventional type, without including fixing elements 30*a-d*.

Figure 6:
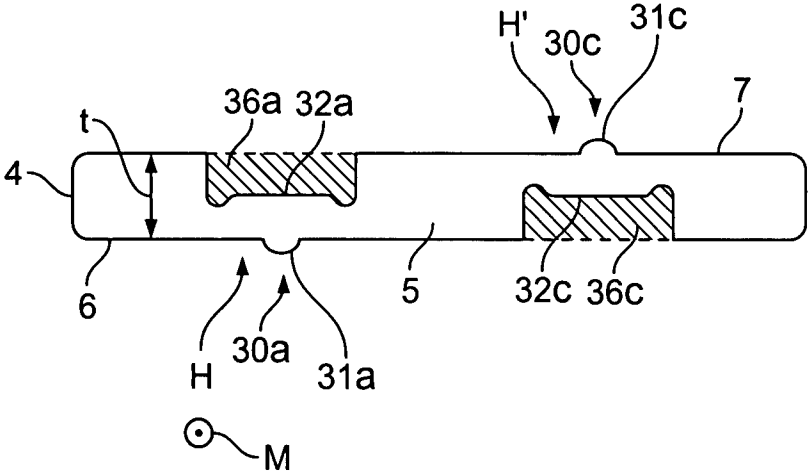
FIG. 6, is a further embodiment of the fixing element arranged on the guiding protuberance of the connector according to FIG. 1 as a front view.

FIG. 6 corresponds to a further embodiment of the fixing elements 30*a, c* showing a schematic surface view of the guiding protuberance 4. The same references are used for the elements which correspond by their function or their structure to the elements in the embodiments of FIGS. 1 to 5. For the sake of conciseness, only the differences relative to the embodiments of FIGS. 1 to 5 will be described.

The front section 5 of the guiding protuberance 4 is outside the plane of projection. The fixing element 30*a* is arranged in the guiding surface 6 and the fixing element 30*c* is arranged in the guiding surface 7. The displacement components 31*a, c* are arranged back-to-back and with a space between them and relative to the lateral edges of the guiding section 4 perpendicular to the coupling direction M. The fixing elements 30*a, c* are shown as a single piece, the resilient sections 32*a, c* and the displacement components 31*a, c* being integral with the fixing elements 30*a, c*. In order to increase the flexibility of the resilient sections 32*a, c* compared with the surrounding sections of the guiding protuberance 4, the thickness t of the guiding protuberance 4 measured perpendicular to the coupling direction M is reduced in the zone of the fixing elements 30*a, c*. The cut-out sections 36*a, c* of the guiding protuberance 4, which are shaded, are of cylindrical shape and extend parallel to the coupling direction M at least near the residual sections 32*a, c*. The cut-out sections 36*a, c* basically have a rectangular impression, the edges of the impression being chamfered or flattened to better distribute the mechanical forces when the residual sections 32*a, c* are deformed or distorted. The cut-out sections 36*a, c* have the function of deformation receptacles.

Figure 7:
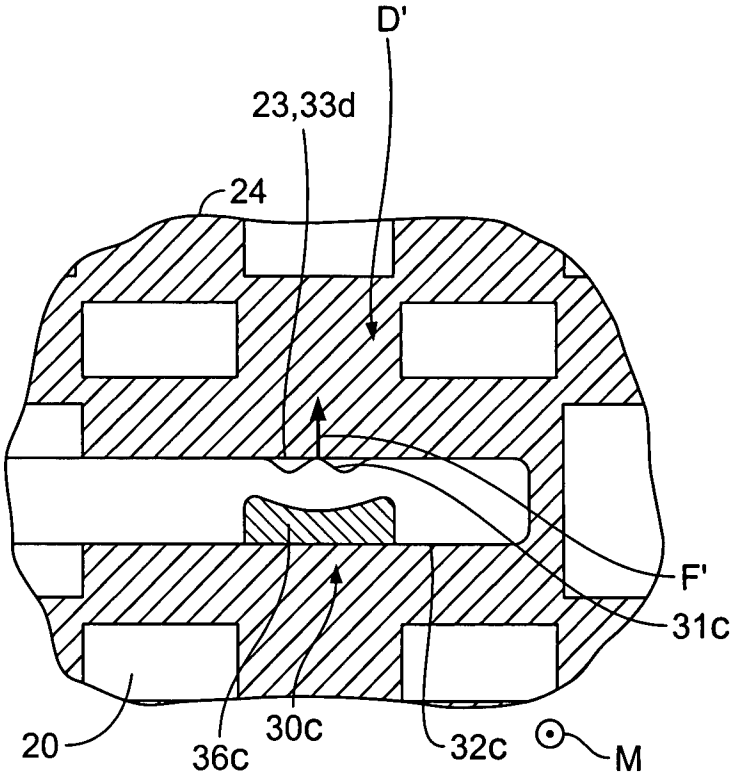
FIG. 7, is a cut-out schematic view of the embodiment according to FIG. 6, the guiding protuberance being inserted into the guiding pocket.

FIG. 7 is a schematic cut-out view of the guiding protuberance 4 of FIG. 6, inserted into the guiding pocket 23. The cutting plane is arranged transversely to the coupling direction M at the height of the displacement components 31*c*. The details of the fixing elements 30*a, c* are described, for example, in fixing element 30*c*.

The displacement component 31*c* is displaced and exerts a pressure against the side wall 33*d* of the support body 24 of the electrical coupling connector 20, producing a force fit between the electrical connector 1 and the electrical coupling connector 20. The resilient section 32*c* is deformed and bends towards the cut-out section 36*c*, which still appears as shaded.

The support body 24 may fill the cut-out section 36*c*, or the support body 24 may be designed so that a free space will form in the cut out section 36*c* if the guiding protuberance 4 is inserted into the guiding pocket 23. The free space may also be below the cut-out section 36*c* and make abutment against the resilient section 32*c*. Due to the free space, the resilient section 32*c* may be deformed easily. If the free space is below the cut-out section 36*c*, the support body 24 material may act as a dead stop for the fixing element 30*c*. This may prevent excessive stressing of the resilient section 32*c* by distorting it excessively. The support body 24 material near the cut-out section 36*c* may also have greater flexibility than the rest of the support body 24 and maybe deformed by the distorted resilient section 32*c*.

Figure 8:
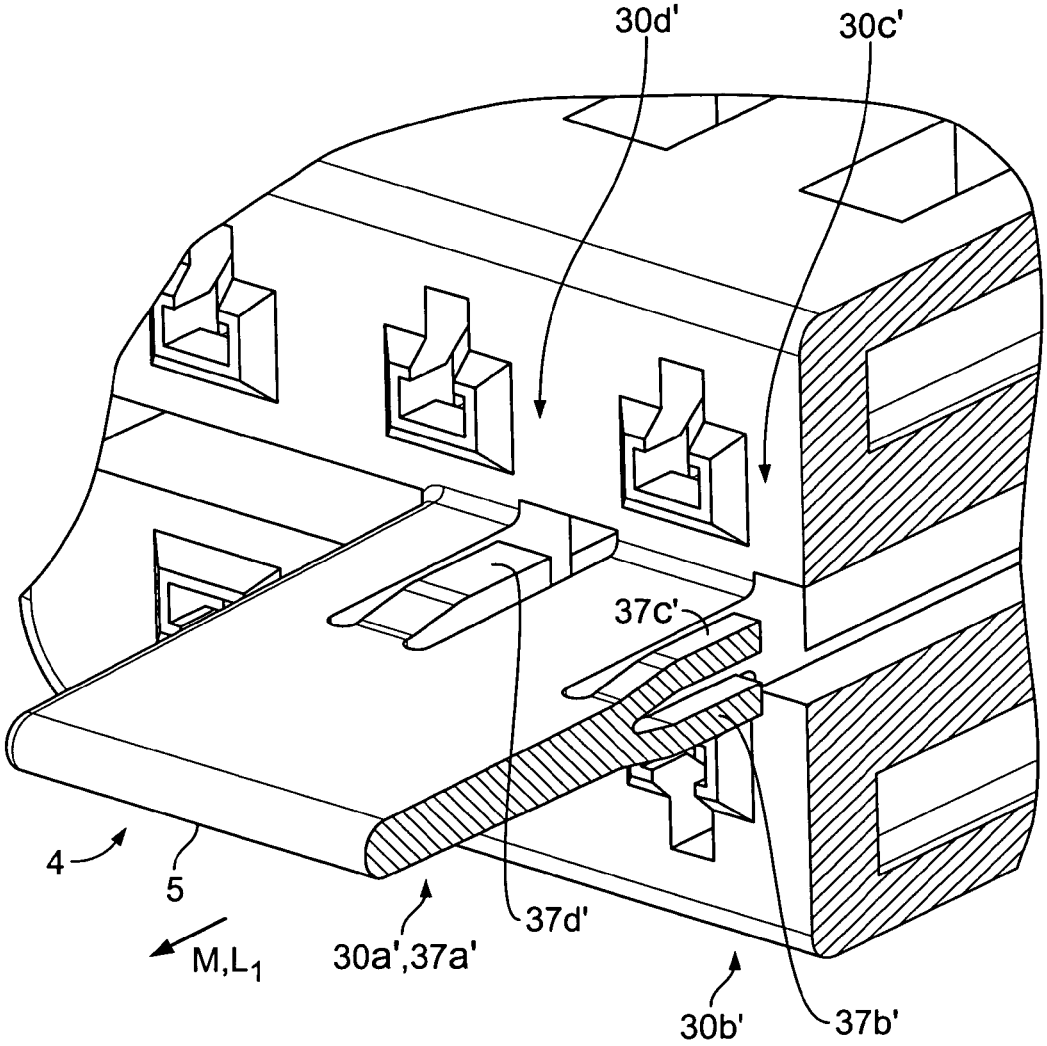
FIG. 8, is a schematic perspective view of a further embodiment of the fixing element arranged on the guiding protuberance.
Figure 10:
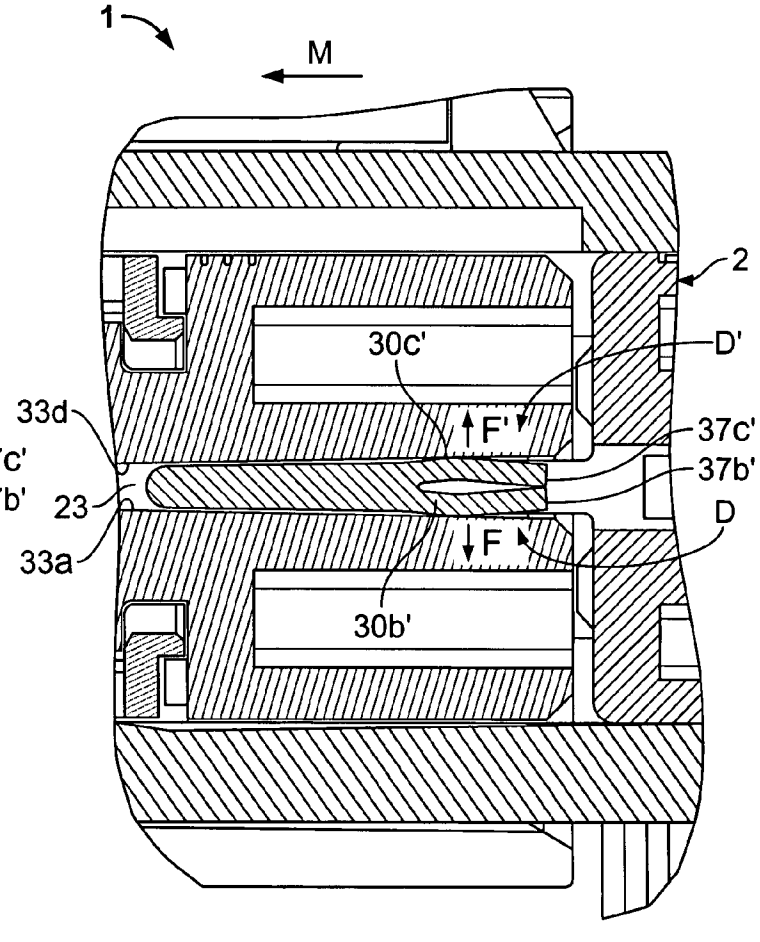
FIG. 10, is an embodiment according to FIGS. 8 and 9, the guiding protuberance being fully inserted into the guiding pocket.
Figure 9:
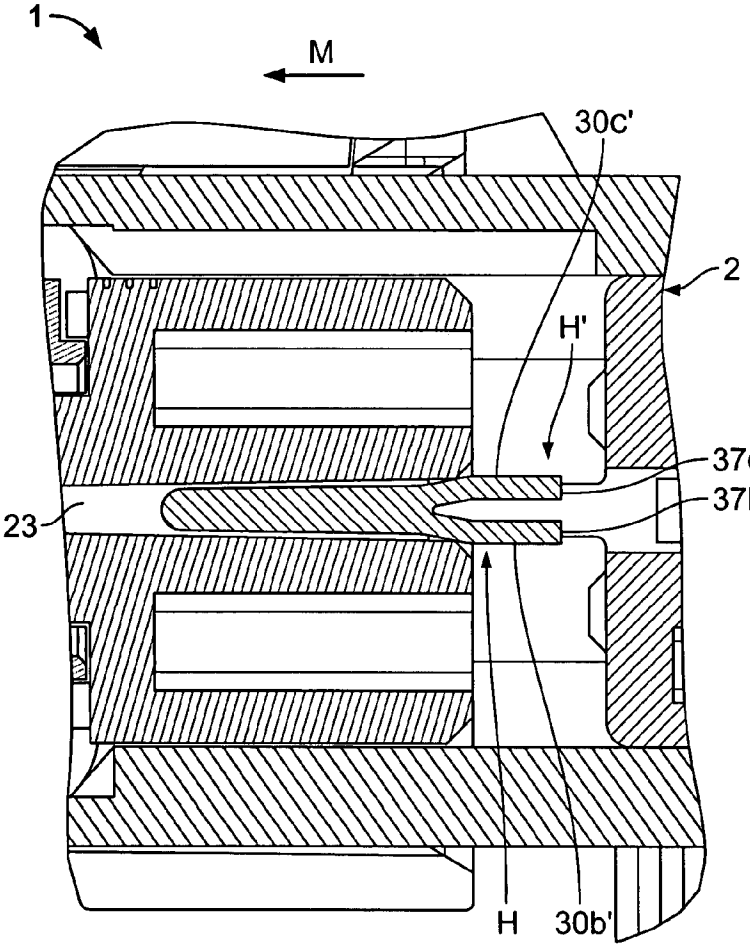
FIG. 9, is a side cut-out schematic view of the embodiment according to FIG. 8, the guiding protuberance being partially inserted into the guiding pocket.

FIGS. 8, 9 and 10 show a further embodiment of the fixing elements 30*a-d* as perspective schematic views or as a side cross-section. The same references are used for the elements which correspond by their function or their structure to the elements in the embodiments shown in FIGS. 1 to 7. For the sake of conciseness, only the differences relative to the embodiments in FIGS. 1 to 7 will be described.

The fixing elements, FIG. 8, are in the shape of a tongue and are designated 30*a'-d'*. The fixing elements 30*a', d'* form a first pair and the fixing elements 30*b', c'* form a second pair of fixing elements. The fixing elements 30*a'-d'* protrude perpendicular to the coupling direction M relative to the guiding protuberance 4. The ends of the fixing elements 30*a'-d'* in the shape of a tongue are directed along the longitudinal direction $L_1$ and are fixed to the guiding protuberance 4. The ends exiting the front section 5 of the guiding protuberance 4 and opposite the longitudinal direction $L_1$ of the fixing elements 30*a'-d'* are designed as free ends 37*a'-d'*. The free ends 37*a'-d'* are spaced apart from each other and in particular relative to the guiding surfaces 6, 7, perpendicular to the longitudinal direction $L_1$. In a side view, the guiding protuberance 4 having the fixing elements 30*a'-d'* is in the shape of a Y. Given that the fixing elements 30*a'-d'* protrude relative to the guiding protuberance 4 perpendicular to the longitudinal direction $L_1$, a separate displacement component 31*a-d* is not necessary.

An electrical connector 1 having a guiding protuberance 4, as shown in FIG. 8, may be used with a corresponding standard connector or an electrical coupling connector 20. The electrical coupling connector 20 must not be adapted, the improved resistance to vibrations being provided by the shape of the guiding protuberance 4, as shown in FIG. 8.

FIG. 9 shows the electrical connectors 1 and 2 in a partially connected condition. The guiding protuberance 4 is inserted into the guiding pocket 23 in the shape of a casing or sheath up to the fixing elements 30*a'-d'* of which only fixing elements 30*b', c'* are shown. The fixing elements 30*b', c'* are not yet deformed or distorted and are shown in their rest position H, H'.

In FIG. 10, the connection of the electrical connectors 1, 2 is more advanced and the fixing elements 30*b', c'* are shown fully inserted into the guiding pocket 23. The fixing elements 30*b', c'* are distorted towards one another by the sidewalls 33*a, d* of the guiding pocket 23, exerting a restoring force F, F' on the sidewalls 33*a*, 33*d*. As a further result of the restoring force F, F' a force fit between the two electrical connectors 1, 2 contributes to the good resistance of the connection.

Due to the elastic features, whilst maintaining a certain amount of rigidity, and the substantially semi-convex shape of the fixing elements 30*b', c'*, their free ends 37*a', d'* are applied against each other and the fixing elements 30*b', c'* in the form of a tongue define an elliptical or bi-convex space in the distorted position D, D'. The restoring forces F, F' are increased due to the contact of the free ends 37*a', d'* in the distorted position D, D'. If the free ends 37*b', c'* are not in contact with each other in the distorted position D, D', the restoring forces F, F' are less important. As a result of the free elliptical space between the fixing elements 30*b', c'*, the fixing elements 30*b', c'* may be more or less deformed perpendicular to the coupling direction M in order to absorb and compensate for the mechanical vibrations.

Figure 11:
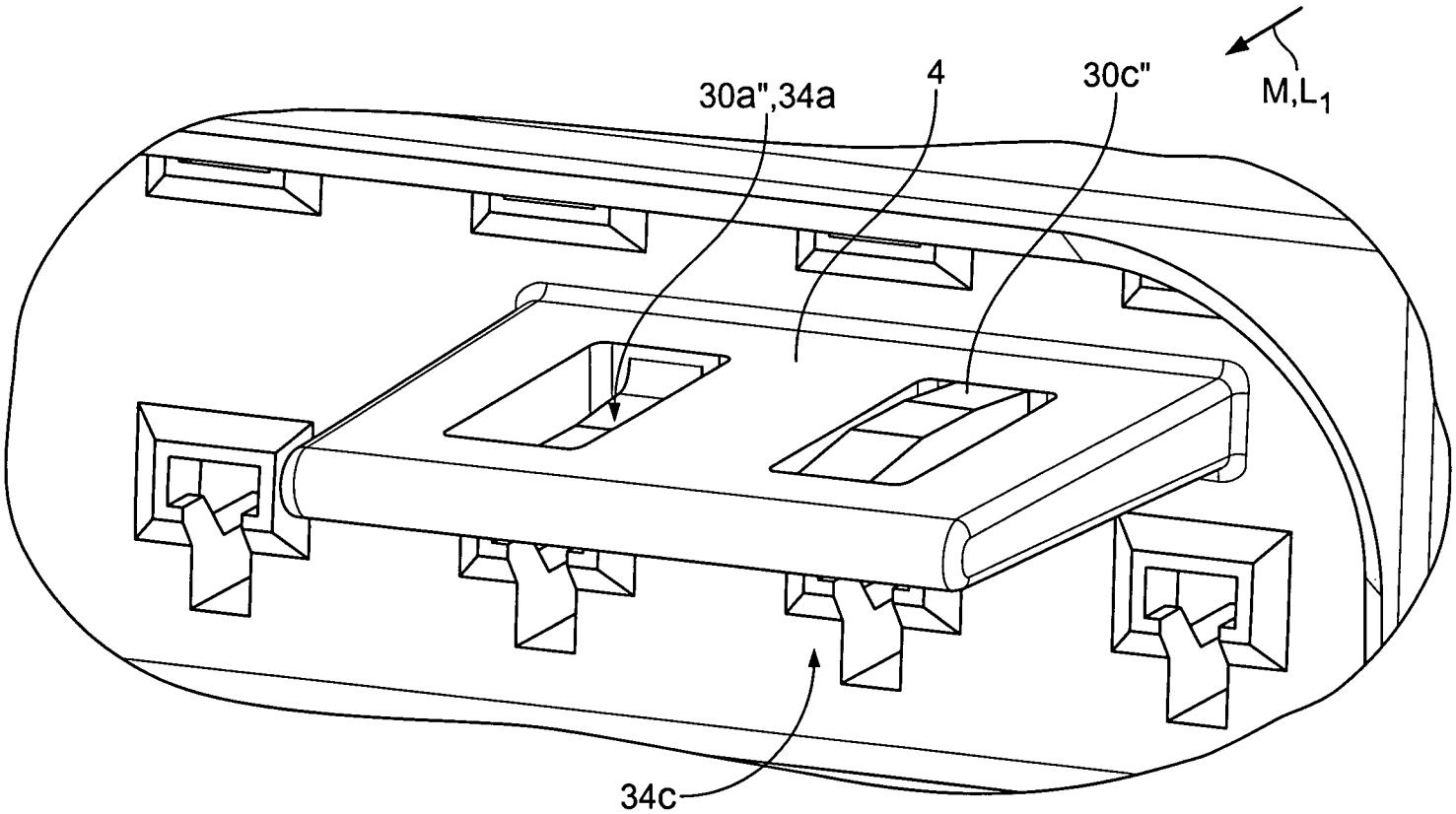
FIG. 11, is a schematic perspective view of a further embodiment of the fixing element arranged on the guiding protuberance.
Figure 13:
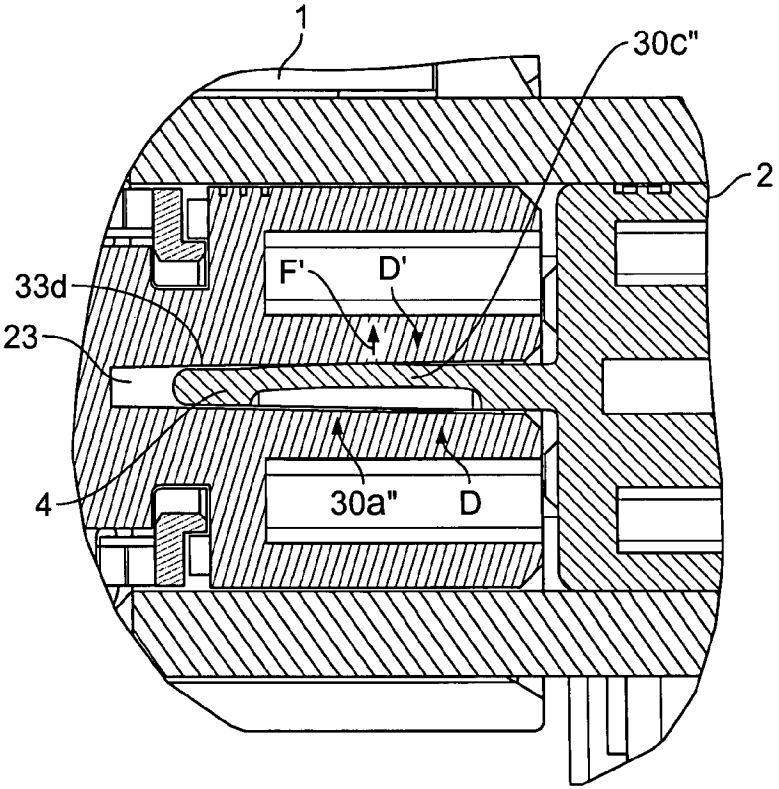
FIG. 13, is an embodiment according to FIGS. 11 and 12, the guiding protuberance being fully inserted into the guiding pocket.
Figure 12:
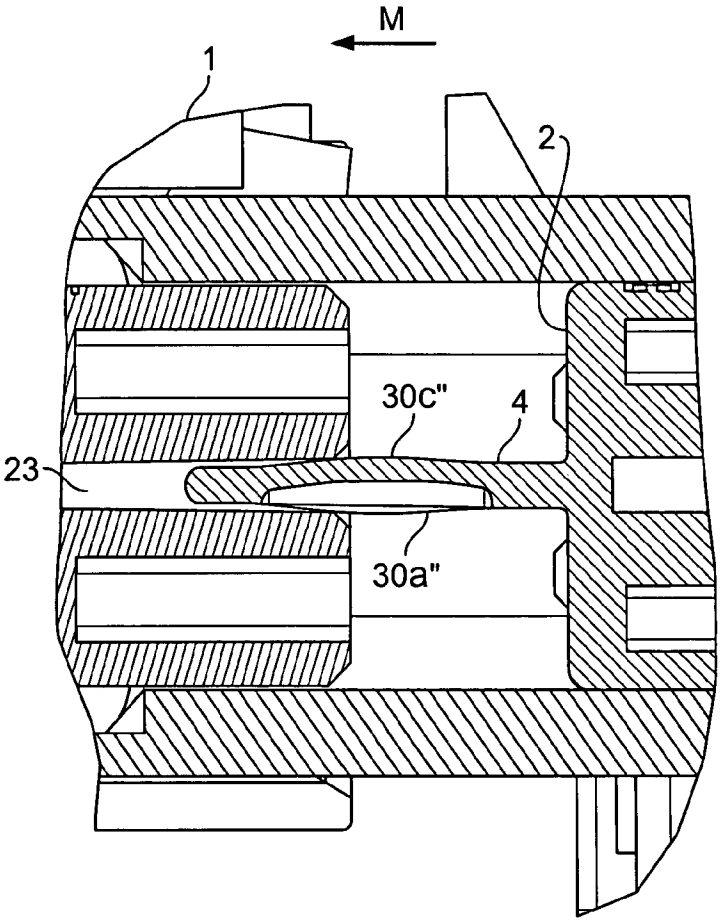
FIG. 12, is a side schematic cut-out view of the embodiment according to FIG. 11, the guiding protuberance being partially inserted into the guiding pocket.

FIGS. 11, 12 and 13 represent a further embodiment of the fixing elements in perspective schematic views and a cross-section side view. The same references are used for the elements which correspond by their function or by their structure to the elements in the embodiments shown in FIGS. 1 to 10. For the sake of conciseness, only the differences relative to the embodiments shown in FIGS. 1 to 10 will be described.

The fixing elements 30*a", c"* in FIG. 11 have the shape of a bridge or spring leaf and are arranged on the two guiding surfaces 6, 7 of the guiding protuberance 4. The two ends of the fixing elements 30*a", c"* are fixed to the guiding protuberance 4. Between their ends, the fixing elements 30*a", c"* have the shape of an arc and distort so that the fixing elements 30*a", c"* protrude from the guiding surfaces 6, 7 perpendicular to the longitudinal direction $L_1$. Deformation receptacles 34*a, c*, delimited by the guiding protuberance 4, are adjacent to the fixing elements 30*a", c"*, thus providing a volume for receiving the fixing element 30*a", c"* which is deformed at least over a portion thereof. The deformation receptacles 34*a, c*, are shaped as a bowl which opens opposite the fixing elements 30*a", c"*.

FIG. 12 shows the electrical connectors 1, 2 in the partially connected condition. The guiding protuberance 4 is inserted into the guiding pocket 23 up to the fixing elements 30*a", c"*. The fixing elements 30*a", c'*, are not yet deformed and are shown in their rest position, H, H'. The cutting plane is arranged in the coupling direction M passing through the fixing element 30*c"*.

In FIG. 13, the connection of the electrical connectors 1, 2 is more advanced. The fixing elements 30*a", c"* are fully inserted into the guiding pocket 23 and are forced into the distorted position D, D'.

The fixing element 30*a"* is not shown in FIG. 13, as it is forced behind an adjacent section of the guiding protuberance 4. The fixing element 30*c"* is shown and exerts a pressure on the side wall 33*d* with the return force F'.

All of the previously described fixing elements 30*a-d*, 30*a'-d'*, 30*a"-d"* may be arranged on guiding surfaces 6-9, 26 of either the guiding protuberance 4, or the guiding pocket 23, or even both.

The invention claimed is:

1. An electrical connector for an electrical connector assembly, the electrical connector being designed to be connected to a coupling electrical connector along a coupling direction, the electrical connector including a socket face with at least one contact section and with a guiding protuberance protruding from the socket face parallel to the coupling direction, wherein the guiding protuberance is provided with a fixing element which is elastically deformable over at least a portion thereof along a direction perpendicular to the coupling direction, the fixing element being arranged on a guiding surface which extends parallel to the coupling direction and is movable from an un-biased position in the unmated position to a resiliently biased position in the mated position.

2. The electrical connector according to claim 1, wherein the fixing element is arranged on a guiding surface which extends parallel to the coupling direction.

3. The electrical connector according to claim 1, wherein the socket face forms part of a support body for electrical contact elements and in that the fixing element is integral with the support body.

4. The electrical connector according to claim 1, wherein a deformation receptacle is arranged on an edge of the fixing element, perpendicular to the coupling direction, providing a space for receiving the deformed fixing element over at least a portion thereof.

5. The electrical connector according to claim 1, wherein the fixing element protrudes perpendicular to the coupling direction.

6. An electrical connector assembly with at least two electrical connectors designed to be connected together along a coupling direction, wherein one of the electrical connectors is designed according to claim 1, the fixing element being arranged in a guiding pocket and being elastically deformable over at least a portion thereof perpendicular to the coupling direction, providing a force fit between the guiding protuberance and the guiding pocket, which occurs at least when the electrical connectors are fully connected.

7. The electrical connector according to claim 1, wherein the fixing element includes a resilient section which is more flexible than the surrounding parts of the electrical connector.

8. The electrical connector according to claim 7, wherein the resilient section is at least designed as a tongue, a bridge or a spring leaf.

9. The electrical connector according to claim 7, wherein the electrical connector includes a displacement component protruding perpendicular to the coupling direction and arranged on a guiding surface.

10. The electrical connector according to claim 9, wherein the displacement component has a protuberance in the shape of a bead or a rib protruding perpendicular to the coupling direction.

11. The electrical connector according to claim 9, wherein the displacement component is integral with the fixing element.

12. The electrical connector assembly according to claim 9, wherein the displacement component is arranged in the resilient section or opposite thereto, at least when the electrical connector and the electrical coupling connector are fully connected.

13. An electrical connector for an electrical connector assembly, the electrical connector being designed to be connected to a coupling electrical connector in the opposite direction of a coupling direction, the electrical connector including a socket face with a guiding pocket for receiving a guiding protuberance of the coupling electrical connector along the coupling direction, the guiding pocket opening towards the socket face and extending parallel to the coupling direction, wherein the guiding pocket is provided with a fixing element which is elastically deformable over at least a portion thereof along a direction perpendicular to the coupling direction, the fixing element being arranged on a guiding surface which extends parallel to the coupling direction and is movable from an un-biased position in the unmated position to a resiliently biased position in the mated position.

14. The electrical connector according to claim 13, wherein the fixing element is arranged on a guiding surface which extends parallel to the coupling direction.

15. The electrical connector according to claim 13, wherein the socket face forms part of a support body for electrical contact elements and in that the fixing element is integral with the support body.

16. The electrical connector according to claim 13, wherein a deformation receptacle is arranged on an edge of the fixing element, perpendicular to the coupling direction, providing a space for receiving the deformed fixing element over at least a portion thereof.

17. The electrical connector according to claim 13, wherein the fixing element protrudes perpendicular to the coupling direction.

18. The electrical connector according to claim 13, wherein the fixing element includes a resilient section which is more flexible than the surrounding parts of the electrical connector.

19. The electrical connector according to claim 18, wherein the resilient section is at least designed as a tongue, a bridge or a spring leaf.

20. The electrical connector according to claim 13, wherein the electrical connector includes a displacement component protruding perpendicular to the coupling direction and arranged on a guiding surface.

21. The electrical connector according to claim 20, wherein the displacement component has a protuberance in the shape of a bead or a rib protruding perpendicular to the coupling direction.

22. The electrical connector according to claim 20, wherein the displacement component is integral with the fixing element.

23. An electrical connector assembly with at least two electrical connectors designed to be connected together along a coupling direction, wherein one of the electrical connectors is designed according to claim 20, the fixing element including a resilient section and being arranged in the guiding pocket and being elastically deformable over at least a portion thereof perpendicular to the coupling direction, providing a force fit between the guiding protuberance and the guiding pocket, which occurs at least when the electrical connectors are fully connected.

24. The electrical connector assembly according to claim 23, wherein the displacement component is arranged in the resilient section or opposite thereto, at least when the electrical connector and the electrical coupling connector are fully connected.

* * * * *